US011361729B2

(12) United States Patent
Chappalli et al.

(10) Patent No.: US 11,361,729 B2
(45) Date of Patent: Jun. 14, 2022

(54) BURN-IN STATISTICS AND BURN-IN COMPENSATION

(71) Applicant: Apple Inc., Cupertino, CA (US)

(72) Inventors: Mahesh B. Chappalli, San Jose, CA (US); Christopher P. Tann, San Jose, CA (US); Peter F. Holland, Los Gatos, CA (US); Guy Côté, Aptos, CA (US); Stephan Lachowsky, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 147 days.

(21) Appl. No.: 15/861,215

(22) Filed: Jan. 3, 2018

(65) Prior Publication Data

US 2019/0080666 A1 Mar. 14, 2019

Related U.S. Application Data

(60) Provisional application No. 62/556,160, filed on Sep. 8, 2017.

(51) Int. Cl.
*G09G 5/00* (2006.01)
*G09G 3/00* (2006.01)
(Continued)

(52) U.S. Cl.
CPC ..... *G09G 5/005* (2013.01); *G09G 3/006* (2013.01); *G09G 3/22* (2013.01); *G09G 5/001* (2013.01);
(Continued)

(58) Field of Classification Search
None
See application file for complete search history.

(56) References Cited

U.S. PATENT DOCUMENTS 6,259,492 B1 * 7/2001 Imoto ..... G09G 3/3633 349/174
7,742,032 B2 * 6/2010 Diefenbaugh ..... G09G 3/3406 345/102
(Continued)

FOREIGN PATENT DOCUMENTS

JP 2000-171718 A 6/2000
JP 2010-063036 A 3/2010
(Continued)

OTHER PUBLICATIONS

Partial European Search Report for European Patent Application No. 18189845.3 dated Oct. 19, 2018; 17 pgs.
(Continued)

*Primary Examiner* — Benjamin X Casarez
(74) *Attorney, Agent, or Firm* — Fletcher Yoder P.C.

(57) ABSTRACT

An electronic display pipeline may process image data for display on an electronic display. The electronic display pipeline may include burn-in compensation statistics collection circuitry and burn-in compensation circuitry. The burn-in compensation statistics collection circuitry may collect image statistics based at least in part on the image data. The statistics may estimate a likely amount of non-uniform aging of the sub-pixels of the electronic display. The burn-in compensation circuitry may apply a gain to sub-pixels of the image data to account for non-uniform aging of corresponding sub-pixels of the electronic display. The applied gain may be based at least in part on the image statistics collected by the burn-in compensation statistics collection circuitry.

21 Claims, 12 Drawing Sheets

(51) Int. Cl.
*G09G 5/02* (2006.01)
*G09G 3/22* (2006.01)

(52) U.S. Cl.
CPC ..... *G09G 5/02* (2013.01); *G09G 2320/046* (2013.01); *G09G 2320/048* (2013.01); *G09G 2320/0626* (2013.01); *G09G 2320/0673* (2013.01); *G09G 2330/10* (2013.01)

(56) References Cited

U.S. PATENT DOCUMENTS

| | | | | |
|---|---|---|---|---|
| 10,275,932 | B2 * | 4/2019 | Kozak | H04N 13/106 |
| 2001/0035850 | A1 * | 11/2001 | Okamoto | G09G 3/3406 345/77 |
| 2007/0146385 | A1 * | 6/2007 | Kienhoefer | G09G 3/22 345/593 |
| 2008/0055210 | A1 * | 3/2008 | Cok | G09G 3/006 345/77 |
| 2008/0068305 | A1 * | 3/2008 | Tada | G09G 3/30 345/77 |
| 2008/0284702 | A1 * | 11/2008 | Shidara | G09G 3/20 345/90 |
| 2009/0147032 | A1 * | 6/2009 | Kim | G09G 3/3225 345/690 |
| 2010/0165009 | A1 * | 7/2010 | Mori | G09G 3/3233 345/690 |
| 2011/0227966 | A1 | 9/2011 | Mori | |
| 2013/0321361 | A1 * | 12/2013 | Lynch | G09G 3/3225 345/204 |
| 2014/0176403 | A1 | 6/2014 | Inoue et al. | |
| 2014/0375704 | A1 * | 12/2014 | Bi | G09G 3/3233 345/694 |
| 2016/0267834 | A1 * | 9/2016 | Zheng | G09G 3/3208 |
| 2016/0314760 | A1 * | 10/2016 | Jangda | G09G 3/3208 |
| 2017/0213493 | A1 | 7/2017 | Han | |
| 2019/0362671 | A1 * | 11/2019 | Kuki | G09G 3/3233 |

FOREIGN PATENT DOCUMENTS

| | | | |
|---|---|---|---|
| JP | 2010-139780 | A | 6/2010 |
| JP | 2015-022123 | A | 2/2015 |

OTHER PUBLICATIONS

Japanese Office Action for Japanese Patent Application No. 2018-162577 dated May 25, 2020; 2 pgs.
Chinese Office Action for Chinese Patent Application No. 201811006622.X dated Jun. 1, 2021; 13 pgs.
Office Action for Japanese Patent Application No. 2020-160445 dated Mar. 30, 2022; 3 pgs.

* cited by examiner

BURN-IN STATISTICS AND BURN-IN COMPENSATION

This application claims priority to and benefit from U.S. Provisional Application No. 62/556,160, entitled "Burn-In Statistics and Burn-In Compensation," filed Sep. 8, 2017, the contents of which is incorporated by reference in its entirety.

BACKGROUND

This disclosure relates to image data processing to identify and compensate for burn-in on an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to pixel burn-in. Burn-in is a phenomenon whereby pixels degrade over time owing to the different amount of light that different pixels emit over time. If certain pixels are used more than others, those pixels may age more quickly, and thus may gradually emit less light when given the same amount of driving current or voltage values. This may produce undesirable burn-in image artifacts on the electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to identifying and compensating for burn-in and/or aging artifacts on an electronic display. Burn-in is a phenomenon whereby pixels degrade over time owing to the different amount of light that different pixels may emit over time. As such, burn-in may be understood to be caused by non-uniform sub-pixel aging. That is, if certain pixels are used more frequently than others, or if those pixels are used in situations that are more likely cause undue aging, such as in high temperatures, those pixels may age more than other pixels. As a result, those pixels may gradually emit less light when given the same driving current or voltage values, effectively becoming darker than the other pixels when given a signal for the same brightness level. To prevent this sub-pixel aging effect from causing undesirable image artifacts on the electronic display, specialized circuitry and/or software may monitor and/or model the amount of burn-in that is likely to have occurred in the different pixels. Based on the monitored and/or modeled amount of burn-in that is determined to have occurred, the image data may be adjusted before it is sent to the electronic display to reduce or eliminate the appearance of burn-in artifacts on the electronic display.

In one example, specialized circuitry and/or software may monitor or model a burn-in effect that would be likely to occur in the electronic display as a result of the image data that is sent to the electronic display. Additionally or alternatively, specialized circuitry and/or software may monitor and/or model a burn-in effect that would be likely to occur in the electronic display as a result of the temperature of different parts of the electronic display while the electronic display is operating. Indeed, in some cases, specialized circuitry and/or software may monitor and/or model a burn-in effect that would be likely to occur in the electronic display as a result of a combination of the effect of the image data that is sent to the electronic display and the temperature of the electronic display when the electronic display displays the image data. In fact, it is believed that the amount of burn-in experienced by any pixel of the electronic display may be influenced by the temperature of the pixel and the amount of light it emits. For instance, a pixel may age more rapidly by emitting a larger amount of light at a higher temperature and may age more slowly by emitting a smaller amount of light at a lower temperature.

By monitoring and/or modeling the amount of burn-in that has likely taken place in the electronic display, burn-in gain maps may be derived to compensate for the burn-in effects. Namely, the burn-in gain maps may gain down image data that will be sent to the less-aged pixels (which would otherwise be brighter) without gaining down the image data that will be sent to the pixels with the greatest amount of aging (which would otherwise be darker). In this way, the pixels of the electronic display that have suffered the greatest amount of aging will appear to be equally as bright as the pixels that have suffered the least amount of aging. This may reduce or eliminate burn-in artifacts on the electronic display.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

By monitoring and/or modeling an amount of burn-in that has likely taken place in the electronic display, burn-in gain maps may be derived to compensate for the burn-in effects. The burn-in gain maps may gain down image data that will be sent to the less-aged pixels (which would otherwise be brighter) without gaining down the image data that will be sent to the pixels with the greatest amount of aging (which would otherwise be darker). In this way, the pixels of the electronic display that have suffered the greatest amount of aging will appear to be equally as bright as the pixels that have suffered the least amount of aging. This may reduce or eliminate burn-in artifacts on the electronic display.

Figure 1:
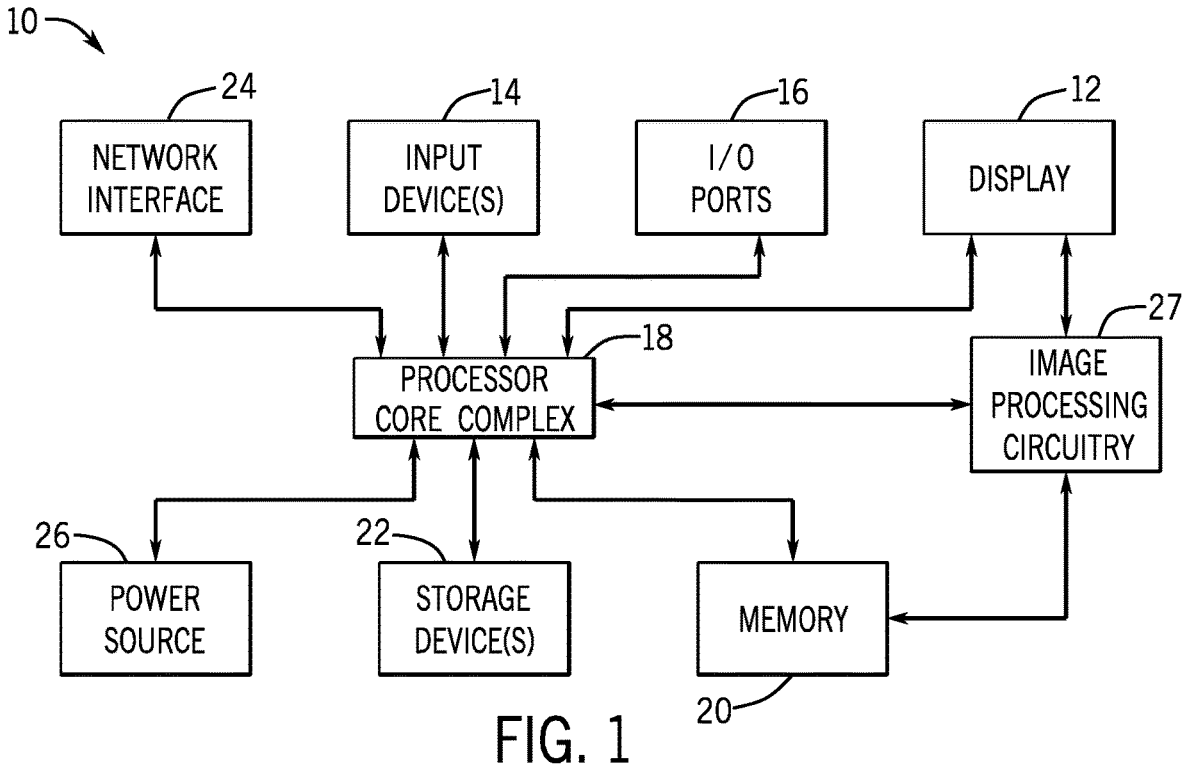
FIG. 1 is a block diagram of an electronic device including an electronic display, in accordance with an embodiment.

To help illustrate, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

In the depicted embodiment, the electronic device 10 includes the electronic display 12, input devices 14, input/output (I/O) ports 16, a processor core complex 18 having one or more processors or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit) may be included in the processor core complex 18.

As depicted, the processor core complex 18 is operably coupled with local memory 20 and the main memory storage device 22. In some embodiments, the local memory 20 and/or the main memory storage device 22 may include tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and/or the like.

In some embodiments, the processor core complex 18 may execute instruction stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

As depicted, the processor core complex 18 is also operably coupled with the network interface 24. Using the network interface 24, the electronic device 10 may be communicatively coupled to a network and/or other electronic devices. For example, the network interface 24 may connect the electronic device 10 to a personal area network (PAN), such as a BLUETOOTH® network (e.g., a radio network generally using radio waves from 2.4-2.485 Gigahertz), a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

Additionally, as depicted, the processor core complex 18 is operably coupled to the power source 26. In some embodiments, the power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the I/O ports 16 and the input devices 14. In some embodiments, the I/O ports 16 may enable the electronic device 10 to interface with various other electronic devices. Additionally, in some embodiments, the input devices 14 may enable a user to interact with the electronic device 10. For example, the input devices 14 may include buttons, keyboards, mice, trackpads, and the like. Additionally or alternatively, the electronic display 12 may include touch sensing components that enable user inputs to the electronic device 10 by detecting occurrence and/or position of an object touching its screen (e.g., surface of the electronic display 12).

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. Additionally, each display pixel may include one or more sub-pixels, which each control luminance of one color component (e.g., red, blue, or green).

As described above, the electronic display 12 may display an image by controlling luminance of the sub-pixels based at least in part on corresponding image data (e.g., image pixel image data and/or display pixel image data). In some embodiments, the image data may be received from another electronic device, for example, via the network interface 24 and/or the I/O ports 16. Additionally or alternatively, the image data may be generated by the processor core complex 18 and/or the image processing circuitry 27.

Figure 2:
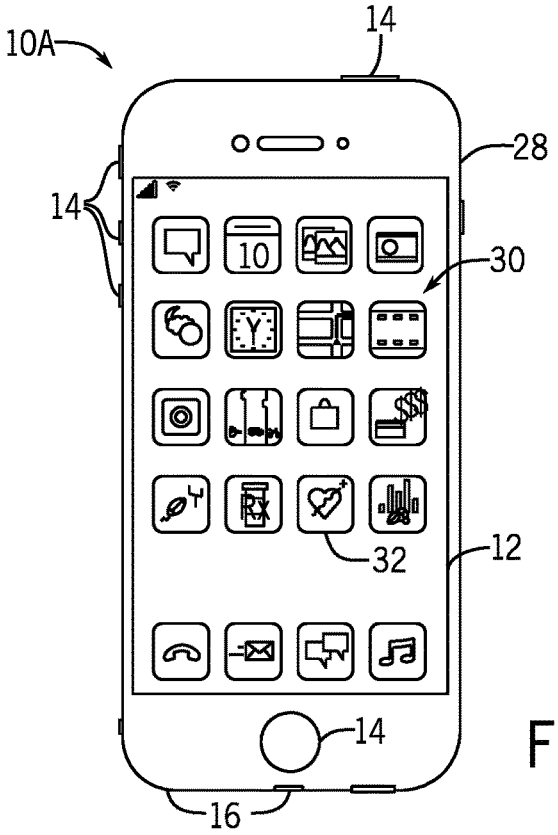
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
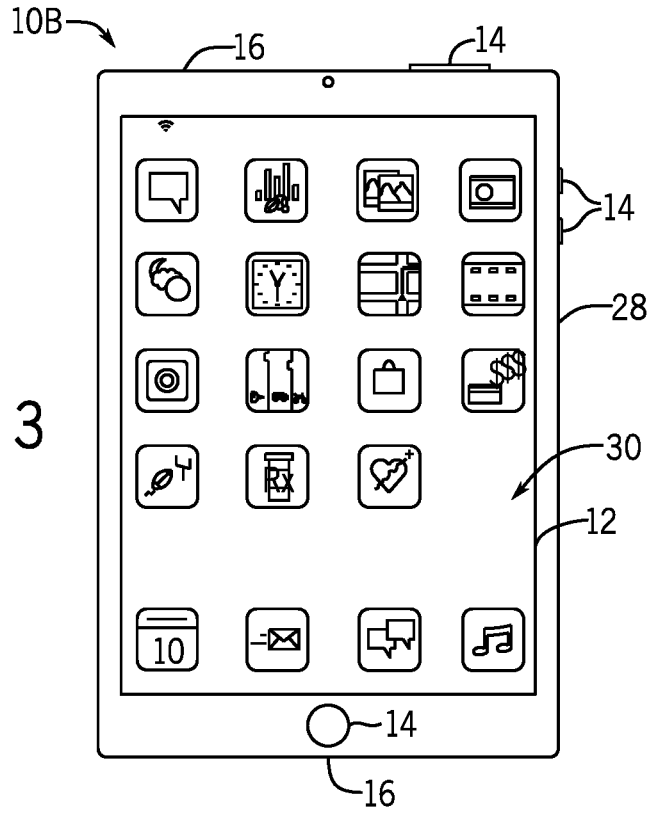
FIG. 3 is another example of the electronic device of FIG. 1, in accordance with an embodiment.
Figure 4:
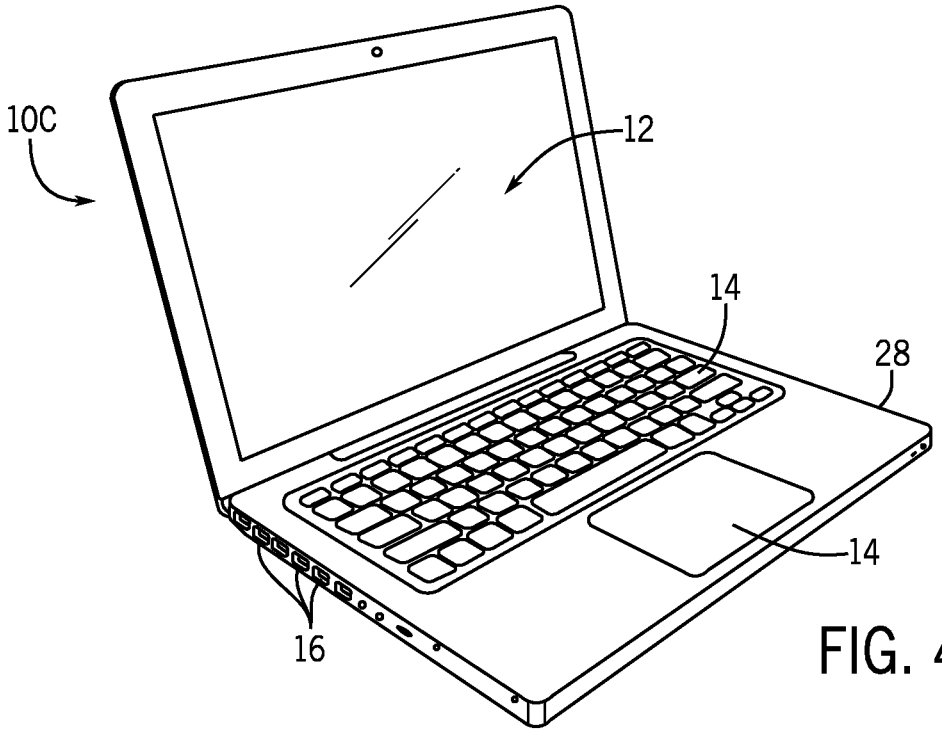
FIG. 4 is another example of the electronic device of FIG. 1, in accordance with an embodiment.
Figure 5:
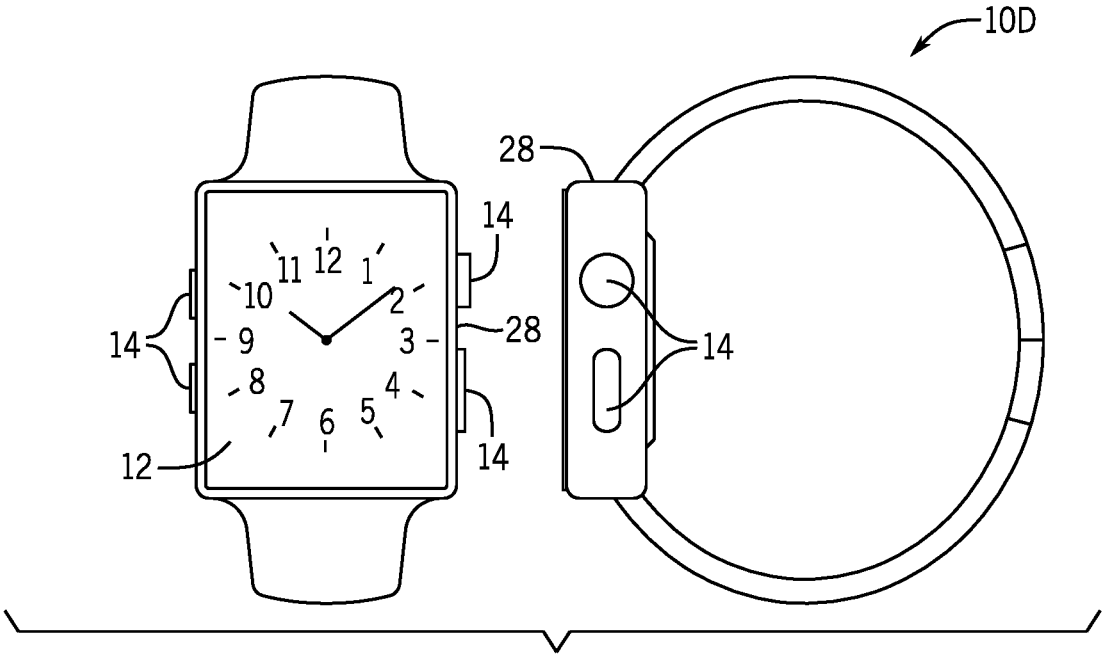
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any IPAD® model available from Apple Inc. A further example of a suitable electronic device 10, specifically a computer 10C, is shown in FIG. 4. For illustrative purposes, the computer 10C may be any MACBOOK® or IMAC® model available from Apple Inc. Another example of a suitable electronic device 10, specifically a watch 10D, is shown in FIG. 5. For illustrative purposes, the watch 10D may be any APPLE WATCH® model available from Apple Inc. As depicted, the tablet device 10B, the computer 10C, and the watch 10D each also includes an electronic display 12, input devices 14, I/O ports 16, and an enclosure 28.

As described above, the electronic display 12 may display images based at least in part on image data received, for example, from the processor core complex 18 and/or the image processing circuitry 27. Additionally, as described above, the image data may be processed before being used to display a corresponding image on the electronic display 12. In some embodiments, a display pipeline may process the image data, for example, to identify and/or compensate for burn-in and/or aging artifacts.

Figure 6:
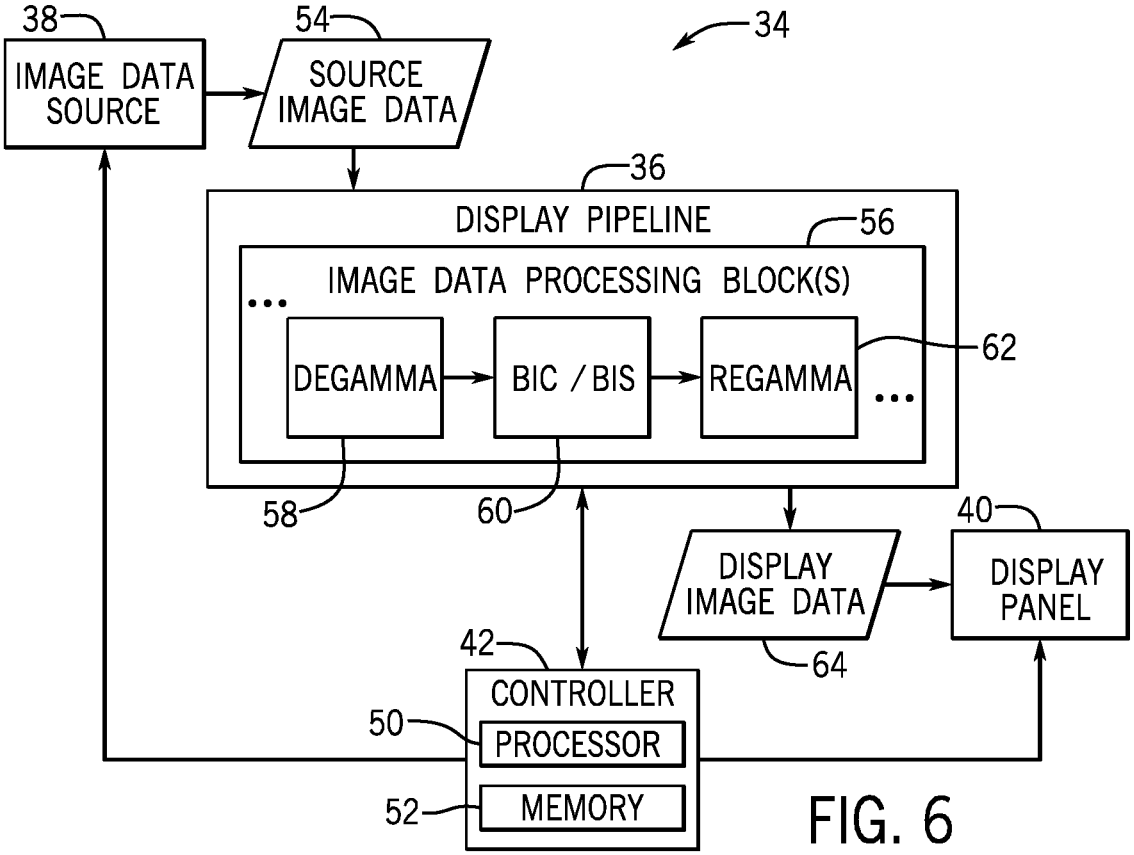
FIG. 6 is a block diagram of a portion of the electronic device of FIG. 1 including a display pipeline that has burn-in compensation (BIC) and burn-in statistics (BIS) collection circuitry, in accordance with an embodiment.

To help illustrate, a portion 34 of the electronic device 10 including a display pipeline 36 is shown in FIG. 6. In some embodiments, the display pipeline 36 may be implemented by circuitry in the electronic device 10, circuitry in the electronic display 12, or a combination thereof. For example, the display pipeline 36 may be included in the processor core complex 18, the image processing circuitry 27, a timing controller (TCON) in the electronic display 12, or any combination thereof.

As depicted, the portion 34 of the electronic device 10 also includes an image data source 38, a display panel 40, and a controller 42. In some embodiments, the controller 42 may control operation of the display pipeline 36, the image data source 38, and/or the display panel 40. To facilitate controlling operation, the controller 42 may include a controller processor 50 and controller memory 52. In some embodiments, the controller processor 50 may execute instructions stored in the controller memory 52. Thus, in some embodiments, the controller processor 50 may be included in the processor core complex 18, the image processing circuitry 27, a timing controller in the electronic display 12, a separate processing module, or any combination thereof. Additionally, in some embodiments, the controller memory 52 may be included in the local memory 20, the main memory storage device 22, a separate tangible, non-transitory, computer readable medium, or any combination thereof.

In the depicted embodiment, the display pipeline 36 is communicatively coupled to the image data source 38. In this manner, the display pipeline 36 may receive source image data 54 corresponding with an image to be displayed on the electronic display 12 from the image data source 38. As described above, the source image data 54 may indicate target characteristics of a portion (e.g., image pixel) of the image using any suitable source format, such as an 8-bit fixed point αRGB format, a 10-bit fixed point αRGB format, a signed 16-bit floating point αRGB format, an 8-bit fixed point YCbCr format, a 10-bit fixed point YCbCr format, a 12-bit fixed point YCbCr format, and/or the like. In some embodiments, the image data source 38 may be included in the processor core complex 18, the image processing circuitry 27, or a combination thereof.

As described above, the display pipeline 36 may operate to process source image data 54 received from the image data source 38. To simplify discussion, the functions (e.g., operations) performed by the display pipeline 36 are divided between various image data processing blocks 56 (e.g., circuitry, modules, or processing stages). It should be understood that, while the term "block" is used here, there may or may not be a logical separation between them. For example, in the depicted embodiment, the image data processing blocks 56 include a DeGamma block 58, a burn-in compensation (BIC)/burn-in statistics (BIS) block 60, and a ReGamma block 62, but this is just one organizational view of the various components that may be part of the display pipeline 36. Moreover, the image data processing blocks 56 may additionally or alternatively include other types of image processing, such as an ambient adaptive pixel (AAP) block, a dynamic pixel backlight (DPB) block, a white point correction (WPC) block, a sub-pixel layout compensation (SPLC) block, a panel response correction (PRC) block, a dithering block, a sub-pixel uniformity compensation (SPUC) block, a content frame dependent duration (CDFD) block, an ambient light sensing (ALS) block, or the like.

As will be described in more detail below, to facilitate subsequent processing, the DeGamma block 58 may receive image data in a gamma-corrected color space (e.g., gamma encoding) and convert it into image data in a linear color space (e.g., linear encoding). A Gamma encoding is a type of encoding that will cause the display panel 40 of the electronic display 12 to display pixel brightnesses in a way that is apparent to the human eye (e.g., where brightness levels generally increase logarithmically or exponentially), whereas linear encoding is a type of encoding that allows for simpler calculations (e.g., where brightness levels generally increase linearly). The DeGamma block 58 may receive image data processed by another of the image data processing blocks 56 of the display pipeline 36 after the source image data 54 has been processed by the other of the image data processing blocks 56, or may receive the source image data 54 directly. The BIC/BIS block 60 may operate on the linearized image data to reduce or eliminate burn-in effects, as well as to collect image statistics about the degree to which burn-in is expected to have occurred on the electronic display 12. The ReGamma block 62 may re-encode the now-compensated linear image data back into a Gamma encoding. The image data output by the ReGamma block 62 may exit the display pipeline 36 or may continue on for further processing by other blocks of the image data processing blocks 56 of the display pipeline 36. In either case, the resulting display image data 64 that is output by the display pipeline 36 for display on the display panel 40 may suffer substantially fewer or no burn-in artifacts.

After processing, the display pipeline 36 may output display image data 64 to the display panel 40. Based at least in part on the display image data 64, the display panel 40 may apply analog electrical signals to the display pixels of the electronic display 12 to display one or more corresponding images. In this manner, the display pipeline 36 may facilitate providing visual representations of information on the electronic display 12.

Figure 7:
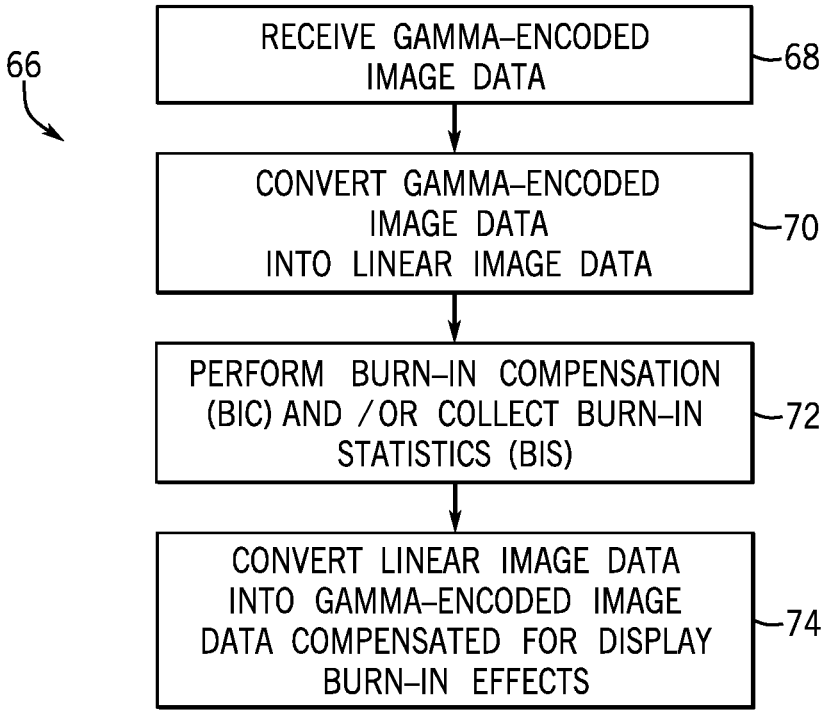
FIG. 7 is a flow diagram of a process for operating the display pipeline of FIG. 6, in accordance with an embodiment.

To help illustrate, an example of a process 66 for operating the display pipeline 36 is described in FIG. 7. Generally, the process 66 includes receiving gamma-encoded image data from the image data source 38 or from another block of the image data processing blocks 56 (process block 68), converting the gamma-encoded image data into linear image data (process block 70), performing burn-in compensation (BIC) and/or collecting burn-in statistics (BIS) (process block 72), and reconverting the resulting image data into gamma-encoded image data compensated for display burn-in effects (process block 74). In some embodiments, the process 66 may be implemented based on circuit connections formed in the display pipeline 36. Additionally or alternatively, in some embodiments, the process 66 may be implemented in whole or in part by executing instructions stored in a tangible non-transitory computer-readable medium, such as the controller memory 52, using processing circuitry, such as the controller processor 50.

Figure 8:
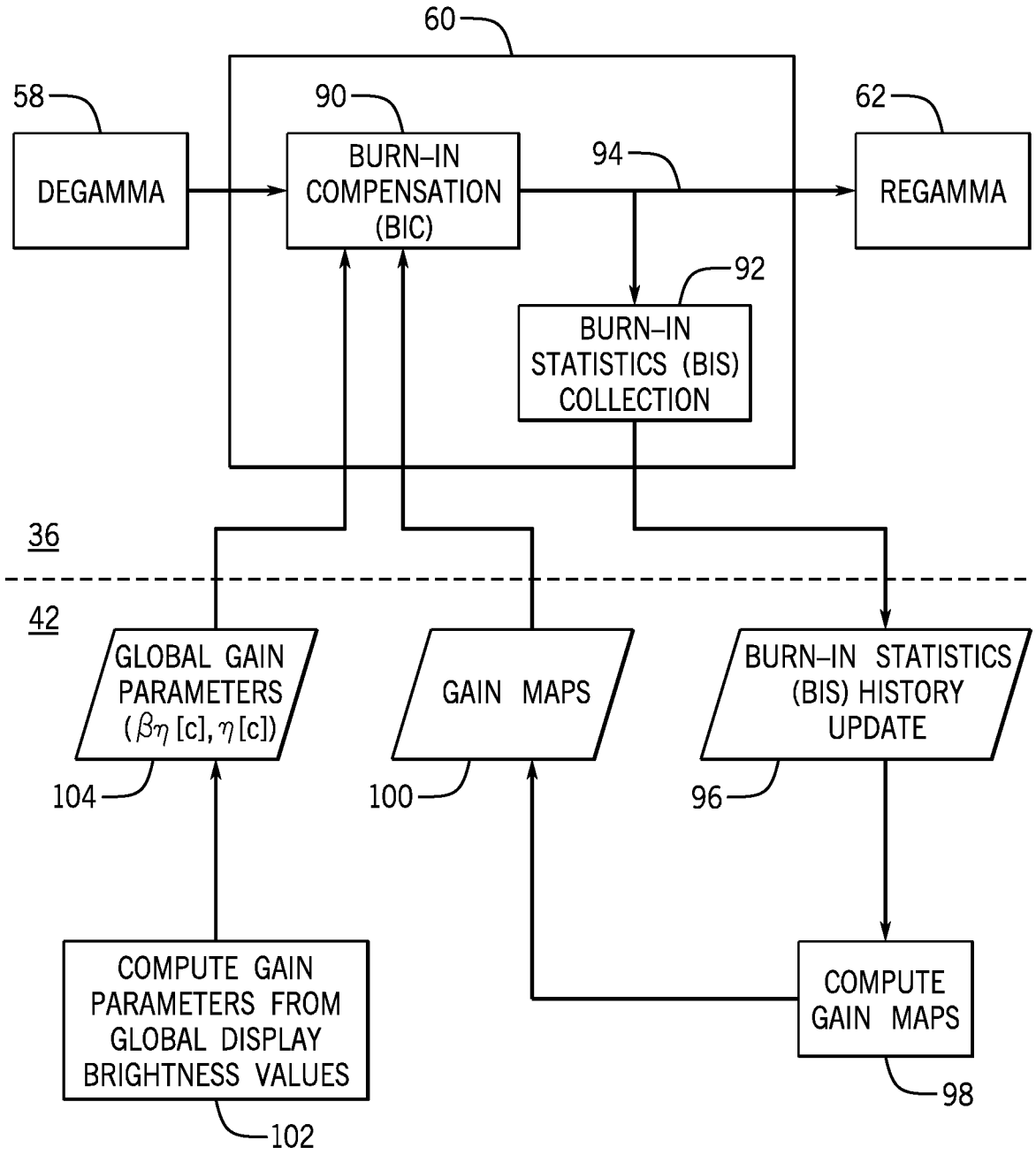
FIG. 8 is a block diagram describing burn-in compensation (BIC) and burn-in statistics (BIS) collection using the display pipeline of FIG. 6, in accordance with an embodiment.

As shown in FIG. 8, the BIC/BIS block 60 may be understood to encompass burn-in compensation (BIC) processing 90 and burn-in statistics (BIS) collection processing 92. The BIC processing 90 may receive linear image data from the DeGamma block 58 and may output linear image data 94 that has been compensated for non-uniform sub-pixel aging on the electronic display 12. As a consequence, when the output linear image data 94 is converted in the ReGamma block 62 into a gamma corrected color space (e.g., sRGB) and displayed on the electronic display 12, burn-in artifacts may be reduced or eliminated.

The BIS collection processing 92 may analyze all or a portion of the output linear image data 94 to generate a burn-in statistics (BIS) history update 96, which represents an incremental update representing an increased amount of sub-pixel aging that is estimated to have occurred since a corresponding previous BIS history update 96. Although the BIC processing 90 and the BIS collection processing 92 are shown as components of the display pipeline 36, the BIS history update 96 may be output for use by the controller 42 or other software (e.g., an operating system, application program, or firmware of the electronic device 10). The controller 42 or other software may use the BIS history update 96 in a compute gain maps block 98 to generate gain maps 100. The gain maps 100 may be two-dimensional (2D) maps of per-color-component pixel gains. For example, the gain maps 100 may be programmed into 2D lookup tables (LUTs) in the display pipeline 36 for use by the BIC processing 90.

The controller 42 or other software (e.g., an operating system, application program, or firmware of the electronic device 10) may also include a compute gain parameters block 102. The compute gain parameters block 102 may compute global gain parameters 104 that may be provided to the display pipeline 36 for use by the BIC processing 90. In the example of this disclosure, these include a normalization factor ($\eta[c]$) and a normalized brightness adaptation factor ($\beta\eta[c]$), which may vary depending on certain global display brightness values and the color component of image data to which they are applied (e.g., red, green, or blue). These particular examples of the global gain parameters 104 will be discussed further below. It should be understood, however, that these factors are meant to be non-limiting examples and that the global gain parameters 104 may represent any suitable parameters that the BIC processing 90 may use to appropriately adjust the values of the gain maps 100 to compensate for burn-in.

Burn-in Compensation (BIC) Processing

Figure 9:
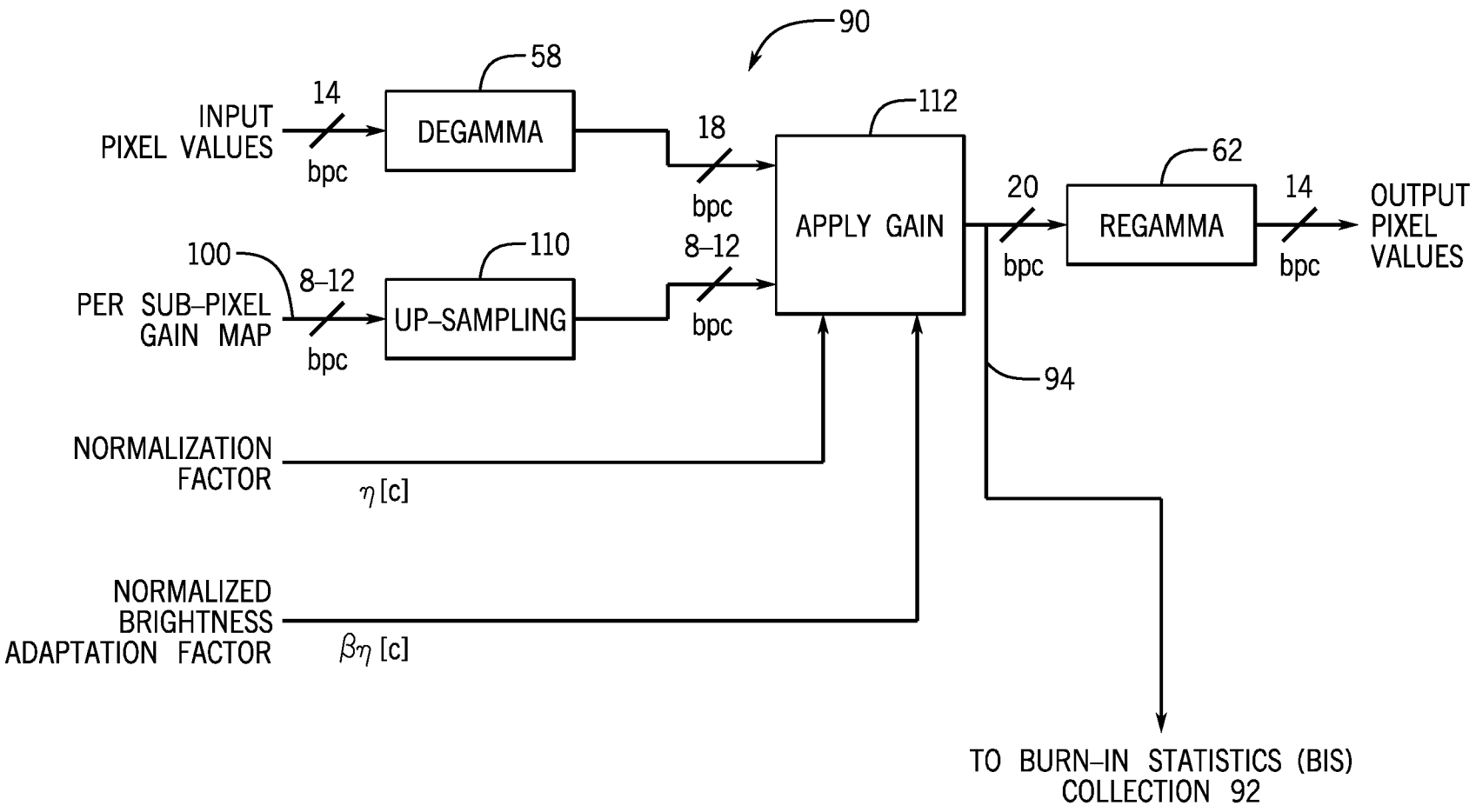
FIG. 9 is a block diagram showing burn-in compensation (BIC) using gain maps derived from the collected burn-in statistics (BIS), in accordance with an embodiment.

A closer view of the BIC processing 90 is shown in FIG. 9. The BIC processing 90 may include an up-sampling block 110 and an apply gain block 112. The up-sampling block 110 may receive the gain maps 100 and obtain the per-component pixel gain value ($\alpha[c](x,y)$) to provide to the apply gain block 112. Here, c represents red (r), green (g), or blue (b) when the electronic display 12 has red, green, and blue color subpixels, but may include other color components if the electronic display 12 has subpixels of other colors (e.g., white subpixels in an RGBW display). The (x,y) terms refer to the spatial location of the pixel on the electronic display 12. The up-sampling block 110 may allow the BIC processing 90 to use gain maps 100 that may be sized to have a lower resolution than the size of the electronic display 12 if desired. When the gain maps 100 have a lower resolution format, the up-sampling block 110 may up-sample values of the gain maps 100 on a per-pixel basis. Several example operations of the up-sampling block 110 will be described further below with reference to FIGS. 10-13.

The pixel gain value ($\alpha[c](x,y)$) may have any suitable format and precision. For example, the precision of the pixel gain value ($\alpha[c](x,y)$) may be between 8 and 12 bits per component, and may vary by configuration. The alignment of the MSb of the pixel gain value ($\alpha[c](x,y)$) may be configurable through a right-shift parameter (e.g., with a default value of 2 and a maximum value of 7). A value of 0 represents alignment with the first bit after the decimal point. For the default value, the MSb of the gain value may be aligned to the fourth bit after the decimal point, effectively yielding a gain with precision between u0.11 and u0.15 precision, corresponding to fetched value with 8 to 12 bits of precision.

From the DeGamma block 58, the apply gain block 112 may receive a current input sub-pixel of image data for a current location (x,y) on the electronic display 12. Here the DeGamma block is shown to convert 14-bit-per-component (bpc) gamma-encoded pixels into 18-bpc linear-encoded pixels, but any suitable bit depths may be used. The apply gain block 112 may also obtain a per-component pixel gain value ($\alpha[c](x,y)$) deriving from the gain maps 100 (which may be up-sampled by the up-sampling block 110). The apply gain block 112 may also obtain the global gain parameters 104 (e.g., the normalization factor ($\eta[c]$) and the normalized brightness adaptation factor ($\beta\eta[c]$)). The apply gain block 112 may apply the per-component pixel gain value ($\alpha[c](x,y)$) to the current input sub-pixel according to the global gain parameters 104 (e.g., the normalization factor ($\eta[c]$) and the normalized brightness adaptation factor ($\beta\eta[c]$)). In one example, the apply gain block 112 may first obtain a compensation value $\sigma[c](x,y)$:

$$\sigma[c](x,y)=(1+\alpha[c](x,y)*\beta[c])*\eta[c]=\eta[c]+\alpha[c](x,y)*\beta\eta[c]$$

where $\alpha[c](x,y)$ represents the per-component pixel gain value from the fetched and/or up-sampled gain maps 100, $\beta[c]$ represents a brightness adaptation factor for a brightness setting of the electronic display 12, $\eta[c]$ represents a normalization factor for a brightness setting of the electronic display 12, and $\beta\eta[c]$ represents a normalized brightness adaptation factor (the product of $\beta[c]$ and $\eta[c]$). The compensation value $\sigma[c](x,y)$ may be encoded in any suitable way, including as an unsigned 1.16 bit number, an unsigned 1.17 bit number, an unsigned 1.18 bit number, an unsigned 1.19 bit number, an unsigned 1.20 bit number, an unsigned 1.21 bit number, an unsigned 1.22 bit number, an unsigned 1.23 bit number, an unsigned 1.24 bit number, an unsigned 1.25 bit number, an unsigned 1.26 bit number, an unsigned 1.27 bit number, an unsigned 1.28 bit number, or the like. The compensation value $\sigma[c](x,y)$ may be clipped to a maximum value of 1.0.

The compensation value $\sigma[c](x,y)$ may be multiplied with the linearized sub-pixel value to obtain the compensated sub-pixel value. When the compensation value $\sigma[c](x,y)$ is an unsigned 1.24 number, obtaining the compensated output sub-pixel value may be represented as follows:

$$\text{outlinear}[c](x,y)=(\text{inlinear}[c](x,y)*\min(\sigma[c](x,y),2^{24})+2^{21})>>22$$

where outlinear[c](x,y) represents the compensated output sub-pixel and inlinear[c](x,y) represents the current input sub-pixel. The compensated output sub-pixels may be converted back to the gamma color space by the reGamma block 62.

Before continuing, the per-component brightness adaptation factor ($\beta[c]$) and normalization factor ($\eta[c]$) are now discussed. The brightness adaptation factor ($\beta[c]$) may be recalculated any time there is a change in the global panel brightness. The brightness adaptation factor $\beta[c]$ may take any suitable form, and may take into account a current brightness setting of the electronic display 12 (e.g., a maximum luminance Lmax that may be displayed on the electronic display 12 at any time). In one example, the brightness adaptation factor $\beta[c]$ may take the form of a second order polynomial function of a global brightness (Lmax):

$$\beta_R=q_{0_R}+(q_{1_R})(L_{max})+(q_{2_R})(L_{max}^2)$$

$$\beta_G=q_{0_G}+(q_{1_G})(L_{max})+(q_{2_G})(L_{max}^2)$$

$$\beta_B=q_{0_B}+(q_{1_B})(L_{max})+(q_{2_B})(L_{max}^2)$$

In the equations for brightness adaptation factor ($\beta[c]$) above, the per-color-component parameters $q_0$, $q_1$, and $q_2$ represent coefficients that may be obtained through experimentation or modeling and may depend on the specific characteristics of the electronic display 12. The brightness adaptation factor ($\beta[c]$) may be encoded in any suitable way, including as an unsigned 1.16 bit number, an unsigned 1.17 bit number, an unsigned 1.18 bit number, an unsigned 1.19 bit number, an unsigned 1.20 bit number, an unsigned 1.21 bit number, an unsigned 1.22 bit number, an unsigned 1.23 bit number, an unsigned 1.24 bit number, an unsigned 1.25 bit number, an unsigned 1.26 bit number, an unsigned 1.27 bit number, an unsigned 1.28 bit number, or the like.

Additionally, the normalization factor ($\eta[c]$) may also be recalculated any time there is a change in the global panel brightness. The normalization factor may be calculated on a per-component basis and may take into account a maximum gain across all channels ($\alpha_{max}$):

$$\eta_R=(1+\alpha_{max}\times\beta_R)^{-1}$$

$$\eta_G=(1+\alpha_{max}\times\beta_G)^{-1}$$

$$\eta_B=(1+\alpha_{max}\times\beta_B)^{-1}$$

The normalization factor ($\eta[c]$) may be encoded in any suitable way, including as an unsigned 1.16 bit number, an unsigned 1.17 bit number, an unsigned 1.18 bit number, an unsigned 1.19 bit number, an unsigned 1.20 bit number, an unsigned 1.21 bit number, an unsigned 1.22 bit number, an unsigned 1.23 bit number, an unsigned 1.24 bit number, an unsigned 1.25 bit number, an unsigned 1.26 bit number, an unsigned 1.27 bit number, an unsigned 1.28 bit number, or the like. In some cases, the normalization factor (η[c]) may be encoded in the same format as the brightness adaptation factor (β[c]). As mentioned above, the global gain parameters 104 may include the normalization factor (η[c]) and the normalized brightness adaptation factor (βη[c]). The normalized brightness adaptation factor (βη[c]) may be obtained by multiplying the brightness adaptation factor (β[c]) by the normalization factor (η[c]). These values may be updated and provided to the apply gain block 112 at any suitable frequency. In some cases, the normalization factor (η[c]) and the normalized brightness adaptation factor (βη[c]) may be updated once every frame and/or every time the global brightness settings change (e.g., every time the maximum luminance Lmax changes). In other cases, the normalization factor (η[c]) and the normalized brightness adaptation factor (βη[c]) may be updated less often (e.g., once every other frame, once every 5 frames, once per second, once per 2 seconds, once per 5 seconds, once per 30 seconds, once per minute, or the like). In some cases, the normalization factor (η[c]) and the normalized brightness adaptation factor (βη[c]) may be updated when the global brightness setting of the electronic display 12 has changed beyond at least a threshold amount (e.g., when the maximum luminance Lmax changes by more than 1 nit, more than 2 nits, more than 5 nits, more than 10 nits, more than 20 nits, more than 50 nits, more than 100 nits, more than 200 nits, or the like). The threshold may depend on the characteristics of the electronic display 12, and may be selected to represent a minimum change in luminance that would be apparent to the human eye.

FIGS. 10-13 describe the up-sampling block 110 to extract the per-component pixel gain value (α[c](x,y)) from the gain maps 100. The gain maps 100 may be full resolution per-sub-pixel two-dimensional (2D) gain maps or may be spatially downsampled if desired to save memory and/or computational resources. When the dimensions of the gain maps 100 are less than the full resolution of the electronic display 12, the up-sampling block may up-sample the gain maps 100 to obtain the per-component pixel gain value (α[c](x,y)) mentioned above. The gain maps 100 may be stored as a multiplane-plane frame buffer. When the electronic display 12 has three color components (e.g., red, green, and blue), the gain maps 100 may be stored as a 3-plane frame buffer. When the electronic display has some other number of color components (e.g., a 4-component display with red, green, blue, and white sub-pixels, or a 1-component monochrome display with only gray sub-pixels), the gain maps 100 may be stored with that number of planes.

Each plane of the gain maps 100 may be the full spatial resolution of the electronic display 12, or may be spatially downsampled by some factor (e.g., downsampled by some factor greater than 1, such as 1.5, 2, 2.5, 3, 3.5 4, 4.5, 5, 5.5, 6, 6.5, 7, 7.5, 8, or more). Moreover, the amount of spatial downsampling may vary independently by dimension, and the dimensions of each of the planes of the gain maps 100 may differ. By way of example, a first color component (e.g., red) plane of the gain maps 100 may be spatially downsampled by a factor of 2 in both dimensions (e.g., in both x and y dimensions), a second color component (e.g., green) plane of the gain maps 100 may be spatially downsampled by a factor of 2 in one dimension (e.g., the x dimension) and downsampled by a factor of 4 in the other dimension (e.g., the y dimension), and a third color component (e.g., blue) plane of the gain maps 100 may be spatially downsampled by a factor of 4 in both dimensions (e.g., in both x and y dimensions). Further, in some examples, planes of the gain maps 100 may be downsampled to variable extents across the full resolution of the electronic display 12.

Figure 10:
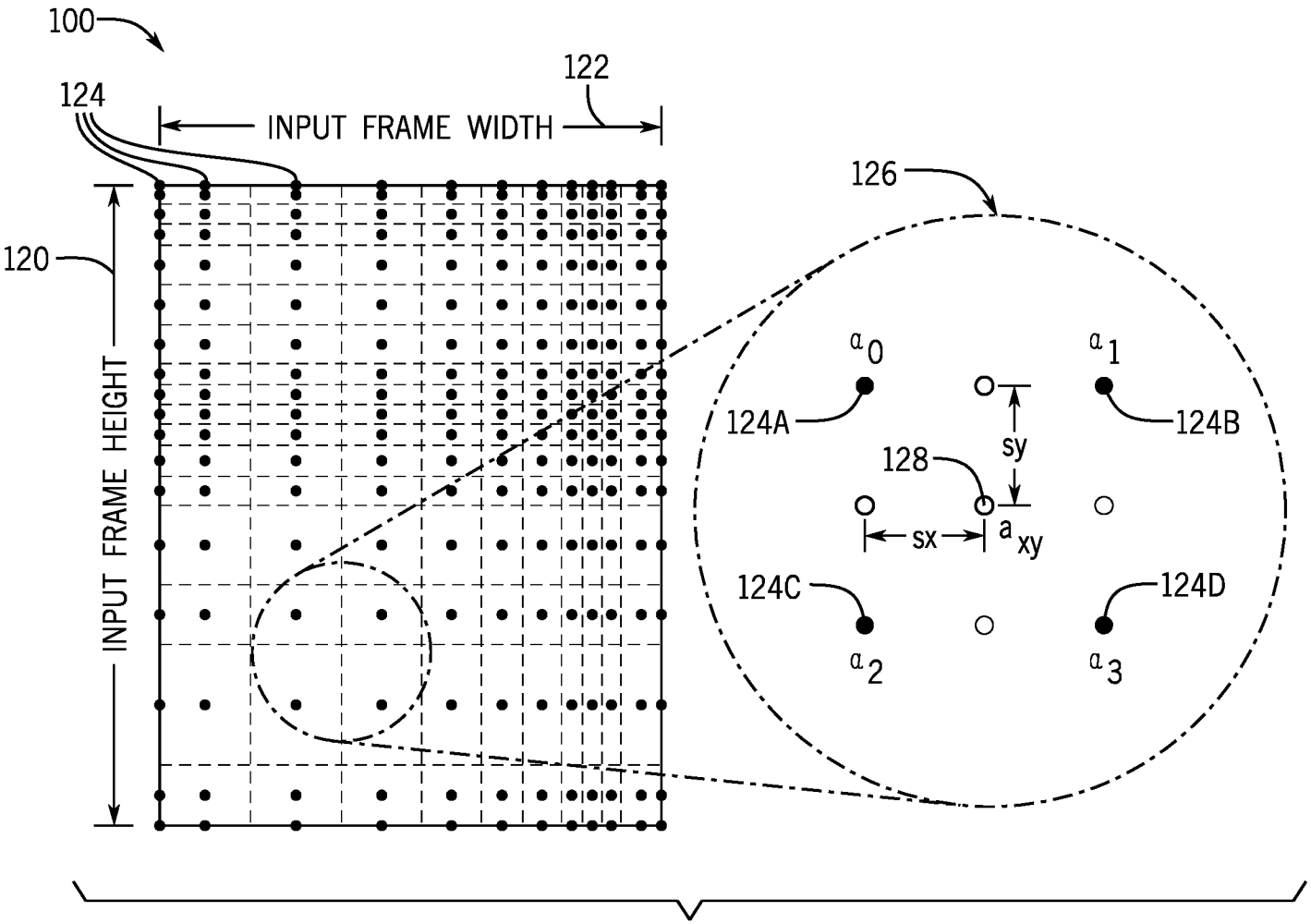
FIG. 10 is a schematic view of a lookup table (LUT) representing an example gain map derived from the collected burn-in statistics (BIS) and a manner of performing ×2 spatial interpolation in both dimensions, in accordance with an embodiment.

One example plane of the gain maps 100 appears in FIG. 10. The plane of the gain maps 100 shown in FIG. 10 represents a downsampled mapping with variably reduced dimensions, and thus has been expanded to show the placement across a total input frame height 120 and an input frame width 122 of the electronic display 12 of the various gain values 124. Moreover, in the example of FIG. 10, the plane of the gain maps 100 has gain values 124 that are spaced unevenly, but as noted above, other planes of gain maps 100 may be spaced evenly.

Whether the gain values 124 are spaced evenly or unevenly across the x and y dimensions, the up-sampling block 110 may perform interpolation to obtain gain values for sub-pixels at (x, y) locations that are between the points of the gain values 124. Bilinear interpolation and nearest-neighbor interpolation methods will be discussed below. However, any suitable form of interpolation may be used.

Figure 11:
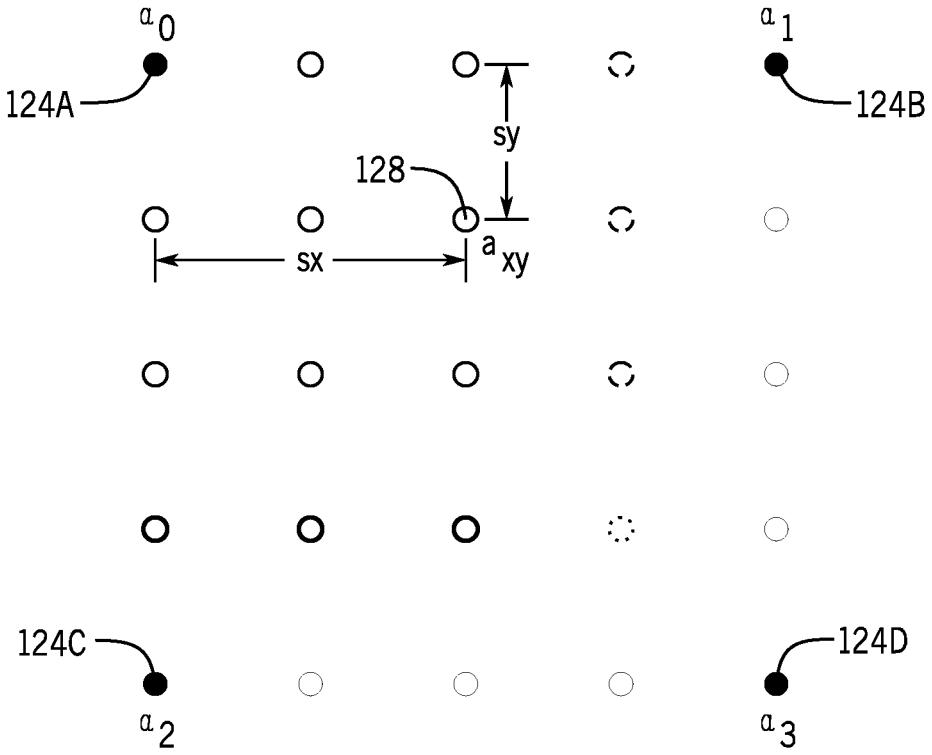
FIG. 11 is a diagram showing a manner of performing ×4 spatial interpolation in both dimensions, in accordance with an embodiment.
Figure 12:
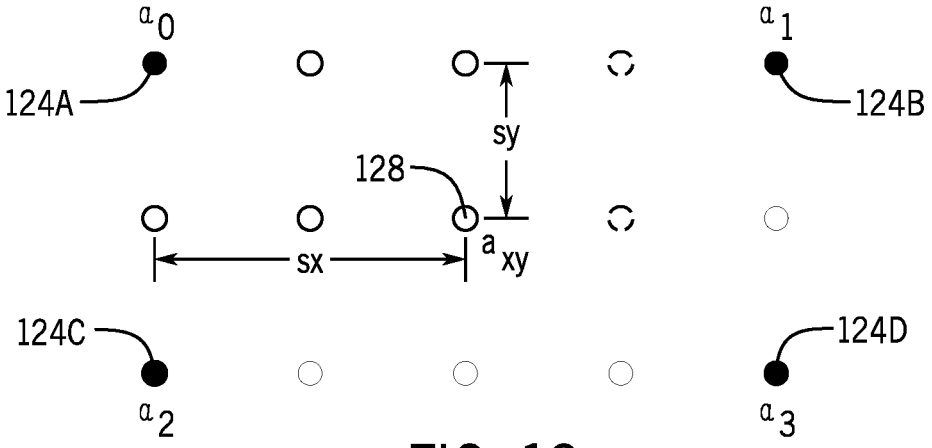
FIG. 12 is a diagram showing a manner of performing ×2 spatial interpolation in one dimension and ×4 spatial interpolation in the other dimension, in accordance with an embodiment.

The examples of FIGS. 10-12 will be discussed together in relation to interpolation between gain values 124. In the example of FIG. 10, an interpolation region 126 of the plane of the gain maps 100 contains the four closest gain values 124A, 124B, 124C, and 124D to a current sub-pixel location 128 when the current interpolation region 126 the plane of the gain maps 100 has been downsampled by a factor 2 in both dimensions in this region. FIG. 11 shows a similar region with downsampling by a factor of 4 in both dimensions of the region, and FIG. 12 shows a similar region with downsampling by a factor of 4 in the x dimension and by a factor of 2 in the y dimension. Given the active interpolation region, panel type, interpolation mode, phase and spatial sub-sampling factor for each color component and/or region, the size of the plane and/or of the interpolation region(s) of the gain maps 100 may be given by:

$$\text{GainMapSize}[c].\text{Width}=\text{ceil}((\text{ComponentWidth}[c]+rx[c]-2)/rx[c])+1$$

$$\text{GainMapSize}[c].\text{Height}=\text{ceil}((\text{BicActiveRegion.Height}+py[c]-\text{bias}[c]-1)/ry[c])+1$$

where

- ComponentWidth[c]=ceil(BicActiveRegion.Width/2) if component c is panel layout sub-sampled
- ComponentWidth[c]=BicActiveRegion.Width if component c is not panel layout sub-sampled
- rx[c] is a spatial sub-sampling factor along the horizontal dimension for component c
- ry[c] is a spatial sub-sampling factor along the vertical dimension for component c
- py[c] is a phase in the vertical dimension in units of 1/ry[c] for component c
- bias[c]=0 if interpolation mode is bilinear for component c
- bias[c]=ry[c]/2 if interpolation mode is nearest neighbor for component c The up-sampling block 110 may perform spatial interpolation of the fetched plane of the gain maps 100. A spatial shift of the plane of the gain maps 100, when down-sampled with respect to the pixel grid of the electronic display 12, may be supported through a configurable initial interpolation phase (e.g., the initial value for sx, sy in the interpolation equations that are presented below) in each of the x and y dimensions. When a plane or an interpolation region of the gain maps 100 is spatially down-sampled, sufficient gain value 124 data points may be present for the subsequent up-sampling to happen without additional samples at the edges of the plane of the gain maps 100. Bilinear and nearest neighbor interpolation are supported. The up-sampling factor and interpolation method may be configurable separately for each of the color components.

Interpolation equations for bilinear and nearest-neighbor interpolation methods are provided below, but it should be appreciated that any other suitable interpolation method may be used. Bilinear interpolation may occur as follows:

$$\alpha_{xy}=((\alpha_{13}*sx)+(\alpha_{02}*(rX-sx))+((rx*ry)>>1))>>\log_2(rx*ry),$$

where $\alpha_{02}=(\alpha_2*sy)+(\alpha_0*(ry-sy))$;

$\alpha_{13}=(\alpha_3*sy)+(\alpha_1*(ry-sy))$;

$sx\in\{0, \ldots, (rx-1)\}$, $sy\in\{0, \ldots, (ry-1)\}$;

rx is a sub-sampling factor along the horizontal dimension; and ry is a sub-sampling factor along the vertical dimension.

Figure 13:
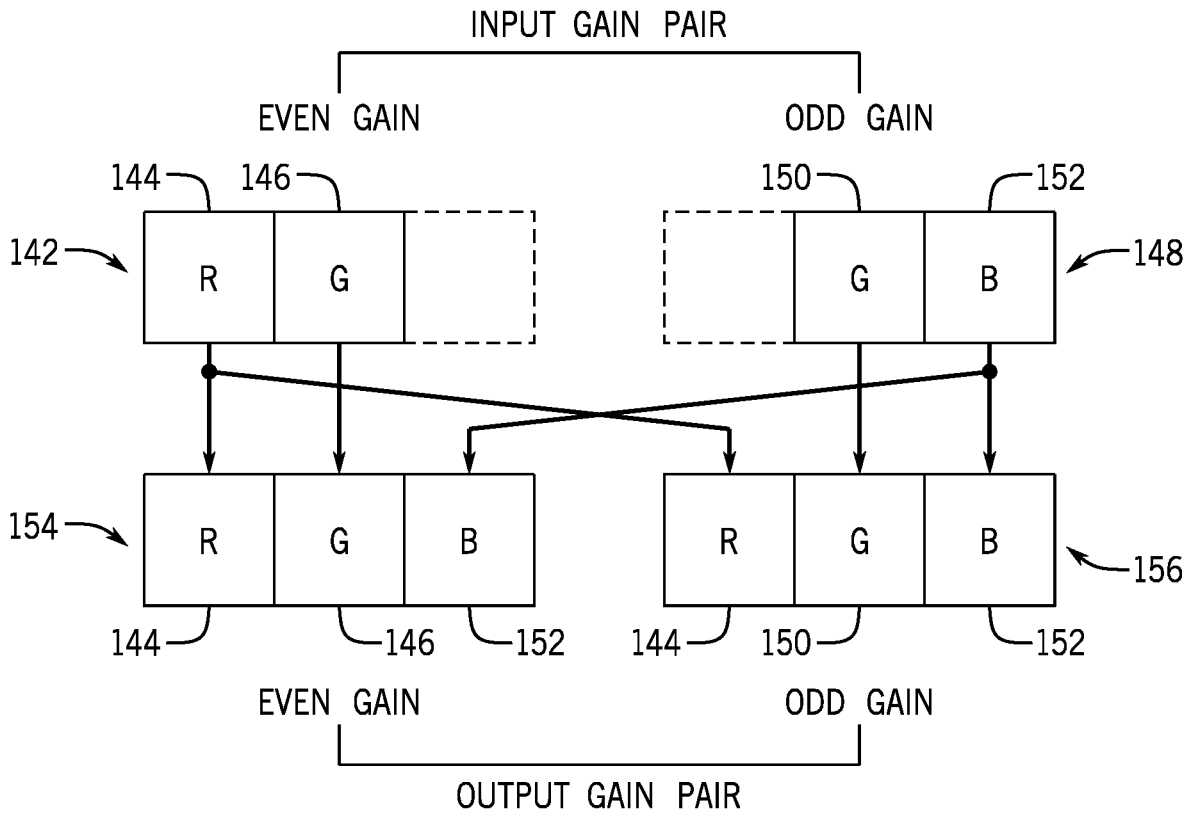
FIG. 13 is a diagram showing a manner of up-sampling two input pixel gain pairs into two output pixel gain pairs, in accordance with an embodiment.

Nearest Neighbor interpolation may occur as follows:

(sx<=(rx>>1)) && (sy<=(ry>>1)) (depicted as bold circles): $\alpha_0$ (sx>(rx>>1)) && (sy<=(ry>>1)) (depicted as dashed circles): $\alpha_1$ (sx<=(rx>>1)) && (sy>(ry>>1)) (depicted as light circles): $\alpha_2$ (sx>(rx>>1)) && (sy>(ry>>1)) (depicted as dotted circles): $\alpha_3$ In some cases, the red and blue planes may be horizontally or vertically sub-sampled due to the panel layout. For example, some electronic displays 12 may support pixel groupings of less than every component of pixels, such as a GRGB panel with a pair of red and green and pair of blue and green pixels. In an example such as this, each red/blue component may be up-sampled by replication across a gain pair, as illustrated in FIG. 13. In the example of FIG. 13, an even gain pixel group 142 includes a red gain 144 and a green gain 146, and an odd gain pixel group 148 includes a green gain 150 and a blue gain 152. The output gain pair may thus include an even gain pixel group 154 that includes the red gain 144, the green gain 146, and the blue gain 152, and an odd gain pixel group 156 that includes the red gain 144, the green gain 150, and the blue gain 152.

Burn-in Statistics (BIS) Collection

As discussed above with reference to FIG. 8, the controller 42 or other software (e.g., an operating system, application program, or firmware of the electronic device 10) may use burn-in statistics (BIS) to generate the gain maps 100. Since the gain maps 100 are used to lower the maximum brightness for pixels that have not experienced as much aging, to thereby match other pixels that have experienced more aging, the gain maps 100 compensate for these non-uniform aging effects and thereby reduce or eliminate burn-in artifacts on the electronic display 12.

As such, the BIS collection processing 92 of the BIC/BIS block 60 may monitor and/or model a burn-in effect that would be likely to occur in the electronic display as a result of the image data that is sent to the electronic display 12 and/or the temperature of the electronic display 12. One or both of these factors may be considered in generating the BIS history update 96 that is provided to the controller 42 or other software for generating the gain maps 100. In one example, shown in FIG. 14, the BIS collection processing 92 may determine a luminance aging factor 170 from a luminance aging lookup table (LUT) 172 or other computational structure and a temperature adaptation factor 174 from a temperature adaptation factor lookup table (LUT) 176 or other computational structure. The luminance aging factor 170 and the temperature adaptation factor 174 may be combined in a multiplier 178 and downsampled by a downsampling block 180 to generate the BIS history update 96. Although the BIS history update 96 is shown as having 7 bits per component (bpc) in FIG. 14, this value may take any suitable bit depth.

Since the total amount of luminance emitted by a pixel of the electronic display 12 over its lifetime has a substantial impact on the aging of that pixel, the luminance aging factor 170 may be determined by a product of the compensated linear image data 94 and a normalized display brightness 182 from a multiplier 184, which is referred to in this disclosure as a normalized input sub-pixel in'[c]. The amount of aging due to luminance emission by the sub-pixel may be modeled as a function of luminance as follows:

$$u_l=((L/L_{limit})*\mathrm{in}_{linear}[c])^{\gamma[c]},$$

where L is the global brightness of the current frame, $L_{limit}$ is the maximum possible brightness for a frame, $\mathrm{in}_{linear}[c]$ is the linearized value of color component c from the linear image data 94 (which may be represented in any suitable manner, such as an unsigned 0.20 number), and γ[c] is a parameter that may depend on the properties of the electronic display 12 and may be determined experimentally or through modeling. The value of $L/L_{limit}$ is represented as the normalized display brightness 182 and may be computed by the controller 42 or other software. In one example, the normalized brightness 182 is represented as an unsigned 1.18 value. The multiplication in the multiplier 184 thus realizes:

$$\mathrm{in}'[c]=\min((\mathrm{in}_{linear}[c]*L_{norm}+(1<<19))>>20,0x3\mathit{fff}).$$

The power function may be modeled in hardware by the luminance aging LUT 172, which may take any suitable form. In one example, the luminance aging LUT 172 represents a 65 entry LUT with entries evenly distributed in the range [0, 218], and which may have a format as unsigned 1.5 values. The luminance aging LUT 172 may be independent per color component and indexed by in'[c] as computed above. Any suitable interpolation between the entries of the luminance aging LUT 172 may be used, including linear interpolation between LUT entries. An example of this process is summarized below. In one example, for each color component:

```
rem=in' & 0xfff
idx=in'>>12
low=LUT[idx]
high=LUT[idx+1]
u_l=(((4096-rem)*low)+(rem*high)+2048)>>12
```

The result is a luminance aging factor 170 (here, shown as $u_l$) that may be taken into account to model the amount of aging on each of the sub-pixels of the electronic display 12 as due to the linear image data 94. However, non-uniform sub-pixel aging is affected not only by the total amount of light emitted over time, but also the temperature of the electronic display 12 while the sub-pixels of the electronic display 12 are emitting light. Indeed, aging is dependent on temperature and temperature can vary across the electronic display 12 due to the presence of components such as the processor core complex 18 and other heat-producing circuits at various positions behind the electronic display 12.

To accurately determine an estimate of the local temperature on the electronic display 12, a two-dimensional (2D)

grid of temperatures 188 may be used. An example of such a 2D grid of temperatures 188 is shown in FIG. 15 and will be discussed in greater detail below. Still considering FIG. 14, a pick tile block 190 may select a particular region (e.g., tile) of the 2D grid of temperatures 188 from the (x, y) coordinates of the currently selected sub-pixel. The pick tile block 190 may also use grid points in the x dimension (grid_points_x), grid points in the y dimension (grid_points_y), grid point steps in the x direction (grid_step_x), and grid point steps in the y direction (grid_step_y). These values may be adjusted, as discussed further below. An current sub-pixel temperature value $t_{xy}$ may be selected from the resulting region of the 2D grid of temperatures 188 via an interpolation block 192, which may take into account the (x, y) coordinates of the currently selected sub-pixel and values of a grid step increment in the x dimension (grid_step_x[$id_x$]) and a grid step increment in the y dimension (grid_step_y[$id_y$]). The current sub-pixel temperature value $t_{xy}$ may be used by the temperature adaptation LUT 176 to produce the temperature adaptation factor 174, which indicates an amount of aging of the current sub-pixel is likely to have occurred as a result of the current temperature of the current sub-pixel.

An example of the two-dimensional (2D) grid of temperatures 188 appears in FIG. 15. The 2D grid of temperatures 188 in FIG. 15 shows the placement across a total input frame height 200 and an input frame width 202 of the electronic display 12 of the various current temperature grid values 204. The current temperature grid values 204 may be populated using any suitable measurement (e.g., temperature sensors) or modeling (e.g., an expected temperature value due to the current usage of various electronic components of the electronic device 10). An interpolation region 206 represents a region of the 2D grid of temperatures 188 that bounds a current spatial location (x, y) of a current sub-pixel. A current sub-pixel temperature value $t_{xy}$ may be found at an interpolated point 208. The interpolation may take place according to bilinear interpolation, nearest-neighbor interpolation, or any other suitable form of interpolation.

In one example, the two-dimensional (2D) grid of temperatures 188 may split the frame into separate regions (a region may be represented a rectangular area with a non-edge grid point at the center), or equivalently, 17×17 tiles (a tile may be represented as the rectangular area defined by four neighboring grid points, as shown in the interpolation region 206), is defined for the electronic display 12. Thus, the 2D grid of temperatures 188 may be determined according to any suitable experimentation or modeling for the electronic display 12. The 2D grid of temperatures 188 may be defined for an entirety of the electronic display 12, as opposed to just the current active region. This may allow the temperature estimation updates to run independently of the BIS/BIC updates. Moreover, the 2D grid of temperatures 188 may have uneven distributions of temperature grid values 204, allowing for higher resolution in areas of the electronic display 12 that are expected to have greater temperature variation (e.g., due to a larger number of distinct electronic components behind the electronic display 12 that could independently emit heat at different times due to variable use).

To accommodate for finer resolution at various positions, the 2D grid of temperatures 188 may be non-uniformly spaced. Two independent multi-entry 1D vectors (one for each dimension), grid_points_x and grid_points_y, are described in this disclosure to represent the temperature grid values 204. In the example of FIG. 15, there are 18 temperature grid values 204 in each dimension. However, any suitable number of temperature grid values 204 may be used. In addition, while these are shown to be equal in number in both dimensions, some 2D grids of temperatures 188 may have different numbers of temperature grid values 204 per dimension. The interpolation region 206 shows a rectangle of temperature grid values 204A, 204B, 204C, and 204D. The temperature grid values 204 may be represented in any suitable format, such as unsigned 8-bit, unsigned 9-bit, unsigned 10-bit, unsigned 11-bit, unsigned 12-bit, unsigned 13-bit, unsigned 14-bit, unsigned 15-bit, unsigned 16-bit, or the like. A value such as unsigned 13-bit notation may allow a maximum panel dimension of 8191 pixels. The first entry may be assumed to be 0 and hence may be implicit. When this is done, only the next 17 entries will be programmed when there are 18 total entries.

Moreover, each tile (e.g., as shown in the interpolation region 206) may start at a temperature grid value 204 and may end one pixel prior to the next temperature grid value 204. Hence, for uniform handling in hardware, at least one temperature grid value 204 (e.g., the last one) may be located a minimum of one pixel outside the frame dimension. Not all of the temperature grid values 204 may be used in all cases. For example, if a whole frame dimension of 512×512 is to be used as a single tile, grid_points_x[0] and grid_points_y[0] may each be programmed to 512. Other values in the vectors may be defined as "don't care," since they will not be accessed. Spacing between successive temperature grid values 204 may be restricted to some minimum number of pixels (e.g., 8, 16, 24, 48, or so pixels) and some maximum number of pixels (e.g., 512, 1024, 2048, 4096, or so pixels). All points in each of the two vectors, grid_points_x and grid_points_y, until the point that lies outside the frame dimension, may be programmed to be monotonically increasing.

The temperature grid values 204 may have any suitable format. In one example, a temperature grid value 204 may be represented as an unsigned 6.2 value. Additionally, referring again to FIG. 14, two independent multi-entry vectors (e.g., 17-entry vectors) for each dimension, grid_step_x and grid_step_y, for step size may be programmed with values dependent on the corresponding tile sizes. For example, grid_step_x may be programmed as (1<<20)/(tile width) and grid_step_y may be programmed as (1<<20)/(tile height) respectively. Programming these values may avoid division in hardware, therefore saving die space and other resources. Indexes id_x and id_y, as well as current offsets, offset_x and offset_y, may be maintained in hardware of the display pipeline 36. The offsets may be incremented by grid_step_x [id_x] and grid_step_y[id_y] every time the input position is incremented by one along the respective dimension. Offsets may be reset to 0 when tile boundaries are crossed in the respective dimension. Offsets may take any suitable value (e.g., unsigned 0.16 format, unsigned 0.17 format, unsigned 0.18 format, unsigned 0.19 format, unsigned 0.20 format, unsigned 0.21 format, unsigned 0.22 format, unsigned 0.23 format, unsigned 0.24 format, or the like). These values may be allowed to saturate when the maximum value is exceeded.

Based on the current x and y position, an interpolated temperature, $t_{xy}$, may be calculated with any suitable form of interpolation. When bilinear interpolation is used using the four surrounding grid points, the computation of the temperature $t_{xy}$, at location (x,y) may take place as outlined in the pseudocode below:

```
id_y = 0, offset_y = 0
id_x = 0, offset_x = 0
for (y = 0; y < height; y++) {
    if (y == grid_points_y[id_y]) {
        id_y++
        offset_y = 0
    }
    id_x = 0
    offset_x = 0
    for (x = 0; x < width; x++) {
        if (x == grid_points_x[id_x]) {
            id_x++
            offset_x = 0
        }
        ty0 = (twod_temperature_lut[id_y ][id_x ] * ((1 << 20) -
        offset_y) +
            twod_temperature_lut[id_y+1][id_x ] * offset_y +
            (1 << 19)
            ) >> 20
        ty1 = (twod_temperature_lut[id_y ][id_x+1] * ((1 << 20) -
        offset_y) +
            twod_temperature_lut[id_y+1][id_x+1] * offset_y +
            (1 << 19)
            ) >> 20
        txy = (ty0 * ((1 << 20) - offset_x) +
            ty1 * offset_x + (1 << 19)) >> 20
        offset_x += grid_step_x[id_x];
    }
    offset_y += grid_step_y[id_y];
}
```

The current sub-pixel temperature value $t_{xy}$ may be used to compute the temperature adaptation factor (ut) 174 for pixels within the active region that is expected to vary with the current sub-pixel temperature value $t_{xy}$ as shown in the following expression:

$$ut=\chi(t_{ref}-t_{xy})/10$$

where $\chi$ is a parameter that is independent per color component and $t_{ref}$ is a chosen reference temperature. The above equation may be modeled in hardware by the temperature adaptation LUT 176. The temperature adaptation LUT 176 may have any suitable number of entries to model the effect of temperature on the aging of the pixels. In one example, the temperature adaptation LUT 176 is a 33-entry LUT with the entries evenly distributed over the range of temperatures represented by $t_{xy}$. The LUT entries may have any suitable precision, and may be unsigned 2.5 values in at least some examples. Any suitable form of interpolation may be used to ascertain values between LUT entries, such as linear interpolation. Moreover, the temperature adaptation LUT 176 may vary by color component. Indeed, the temperature adaptation LUT 176 may include several independent LUTs for each of the color components. One example of the process is outlined in the pseudocode below. Namely, for each color component:

```
rem = txy & 0x7
idx = txy >> 3
low = LUT[idx]
high = LUT[idx + 1]
ut = (((8 - rem) * low) + (rem * high) + 4) >> 3
```

Figure 14:
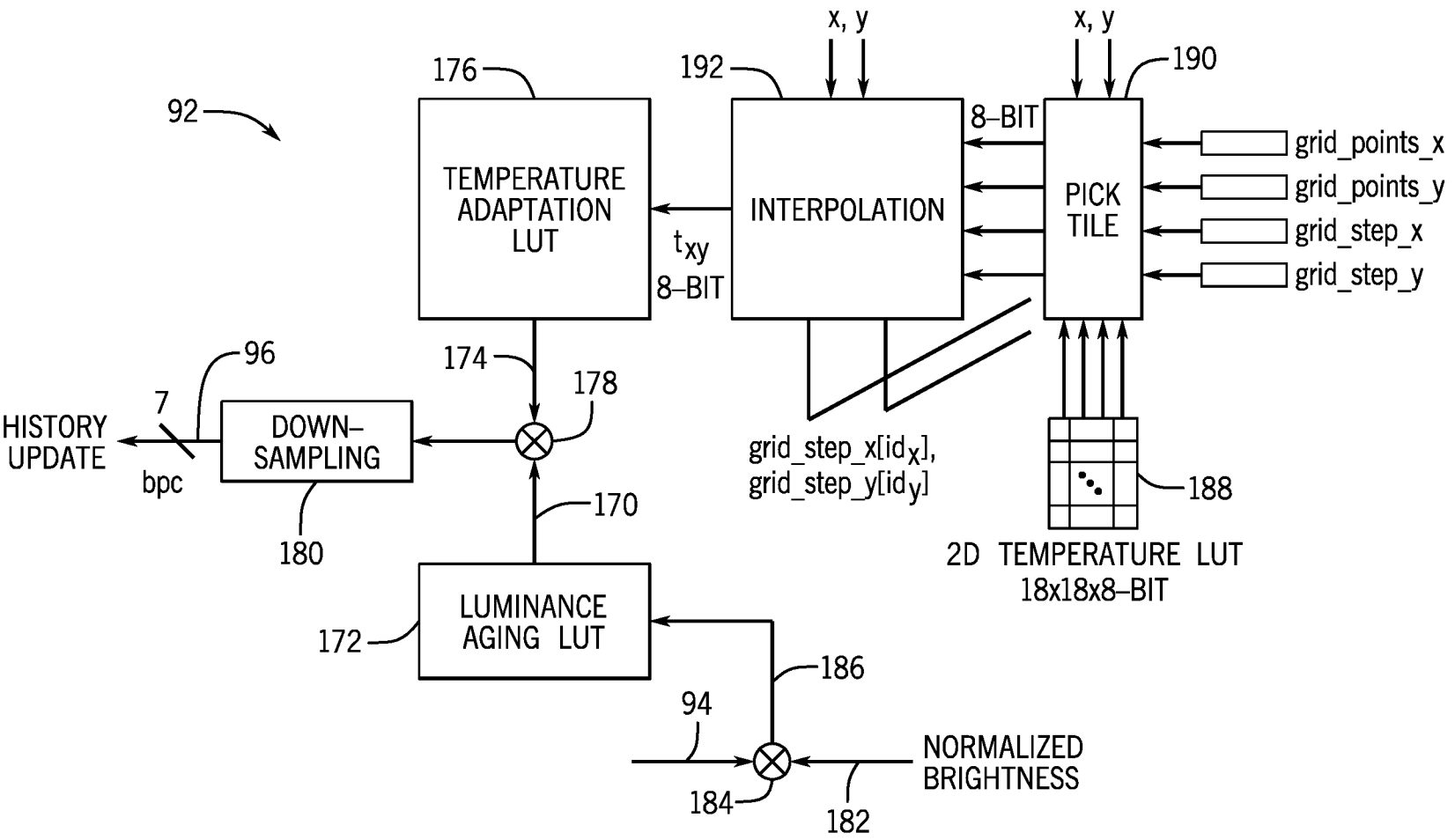
FIG. 14 is a block diagram showing burn-in statistics (BIS) collection that takes into account luminance aging and temperature adaptation, in accordance with an embodiment.
Figure 15:
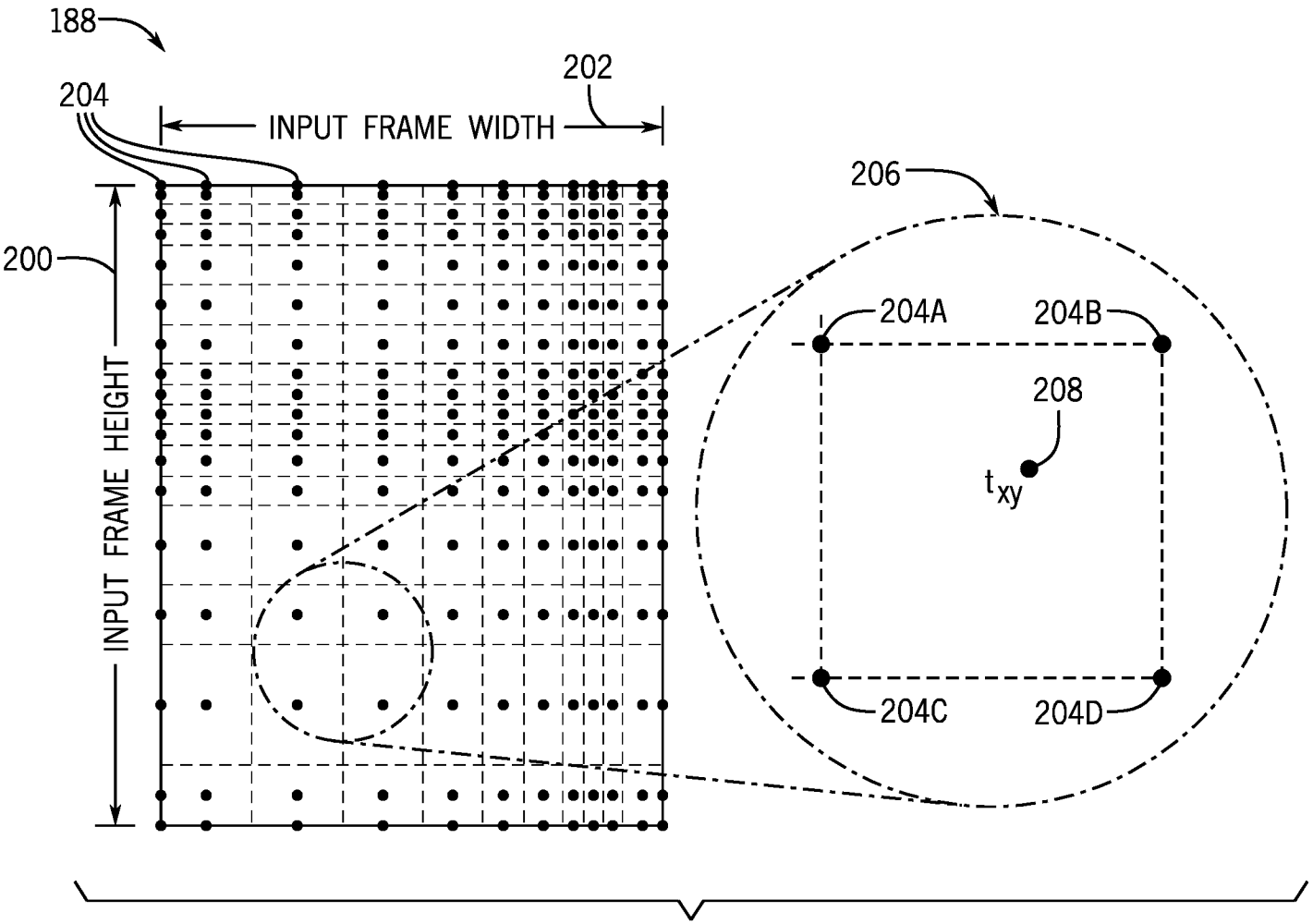
FIG. 15 is a schematic view of an example temperature map and a manner of performing bilinear interpolation to obtain a temperature value, in accordance with an embodiment.

As shown in FIG. 14, the complete BIS history update 96 may involve the multiplication of the luminance aging factor ($u_l$) 170 and the temperature adaptation factor ($u_t$) 174. An example operation of the multiplier 178 and the down-sampling block 180 may take place as follows:

$$u[c]=(u_l[c]*u_t[c]+16)>>5$$

Figure 16:
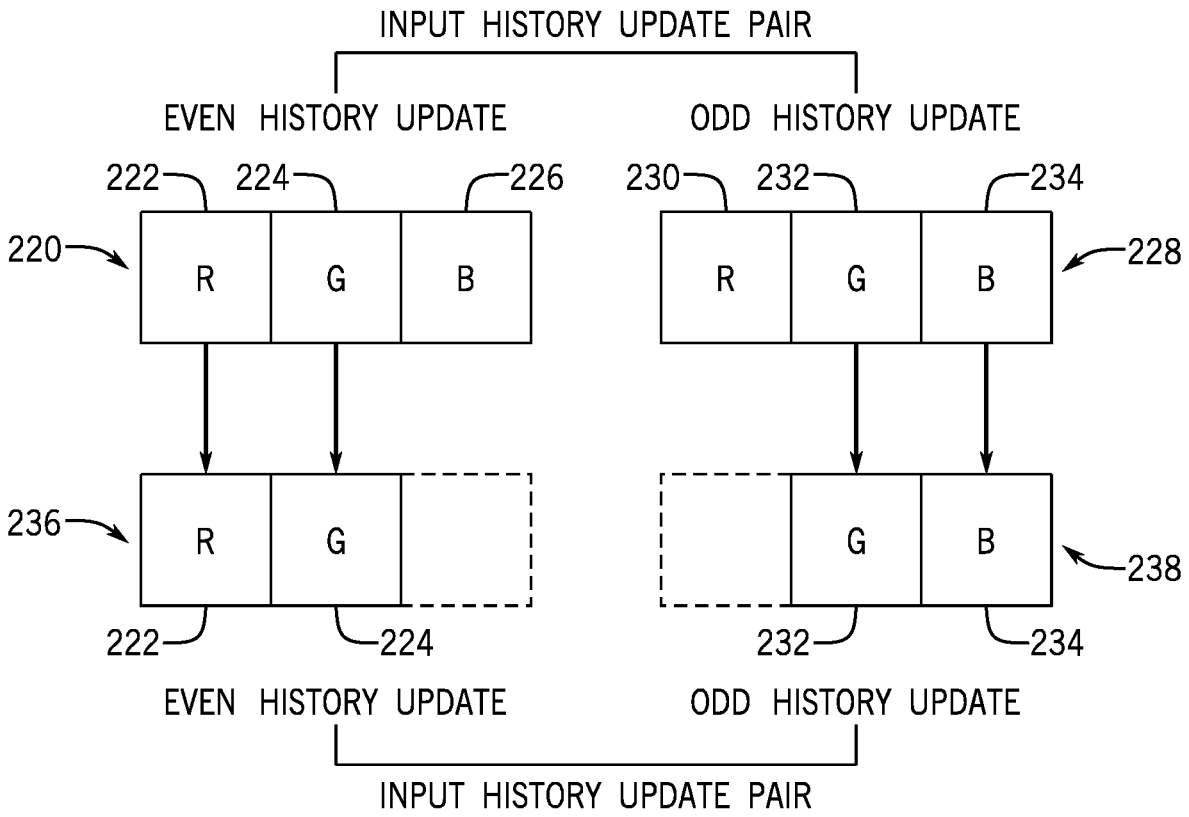
FIG. 16 is a diagram showing a manner of downsampling two input burn-in statistics (BIS) history pixel pairs into two output burn-in statistics (BIS) history pixel pairs, in accordance with an embodiment.

Here, the computed 8-bit history update may be written out as three independent planes with the base addresses for each plane being byte aligned (e.g., 128-byte aligned). Prior to write-out, depending on the type of panel, to maintain a constant line width in the buffer, a zero may be inserted at the end of the line when appropriate. Moreover, the number of components per pixel can be down-sampled from 3 to 2. This is represented in the example of FIG. 16, since some electronic displays 12 may support pixel groupings of less than every component of pixels, such as a GRGB panel with a pair of red and green and pair of blue and green pixels. In an example such as this, each pair of pixels may have the red/blue components dropped to form a history update pair. In the example of FIG. 16, an even history update pixel group 220 includes a red history update value 222, a green history update value 224, and a blue history update value 226, and an odd history update pixel group 228 includes a red history update value 230, a green history update value 232, and a blue history update value 234. To down-sample this pair, the output history update pair may thus include an even history update pixel group 236 that includes the red history update value 222 and the green history update value 224, and an odd history update pixel group 238 that includes the red history update value 230 and the green history update value 232.

By compiling and storing the values in the burn-in statistics (BIS) history update 96, the controller 42 or other software may determine a cumulative amount of non-uniform pixel aging across the electronic display 12. This may allow the gain maps 100 to be determined that may counteract the effects of the non-uniform pixel aging. By applying the gains of the gain maps 100 to the input pixels before they are provided to the electronic display 12, burn-in artifacts that might have otherwise appeared on the electronic display 12 may be reduced or eliminated in advance. Thereby, the burn-in compensation (BIC) and/or burn-in statistics (BIS) of this disclosure may provide a vastly improved user experience while efficiently using resources of the electronic device 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display configured to display images when programmed with display image data; and a display pipeline configured to receive image data and process the image data through one or more image processing blocks to obtain the display image data, wherein the one or more image processing blocks comprise burn-in compensation processing configured to apply gains to sub-pixels of the image data according to one or more burn-in compensation gain maps and one or more global gain parameters, wherein the one or more burn-in compensation gain maps provide a two-dimensional mapping of gains and the one or more global gain parameters adjust the one or more burn-in compensation gain maps such that, when applied to the sub-pixels of the image data, the applied gains reduce a gain of at least one of the sub-pixels of the image data to account for sub-pixel aging non-uniformity on the electronic display and thereby to reduce or eliminate burn-in artifacts that would otherwise appear on the electronic display when the electronic display is programmed with the display image data, wherein the one or more global gain parameters are based at least in part on a global brightness setting of the electronic display, wherein the burn-in compensation processing is configured to determine a change in the global brightness setting, wherein the one or more global gain parameters are recalculated in response to the change of the global brightness setting being greater than a threshold amount.

2. The electronic device of claim 1, wherein the electronic display comprises a self-emissive electronic display having sub-pixels that age non-uniformly due to luminance output, temperature, or both.

3. The electronic device of claim 1, wherein the one or more burn-in compensation gain maps comprises at least a first plane corresponding to a first color component of the sub-pixels of the electronic display, a second plane corresponding to a second color component of the sub-pixels of the electronic display, and a third plane corresponding to a third color component of the sub-pixels of the electronic display.

4. The electronic device of claim 1, wherein the one or more burn-in compensation gain maps are stored in a corresponding one or more frame buffers accessible to the display pipeline.

5. The electronic device of claim 1, wherein the one or more burn-in compensation gain maps have less than a full resolution of the electronic display, and wherein the burn-in compensation processing is configured to up-sample the one or more burn-in compensation gain maps before applying the gains to the sub-pixels of the image data.

6. The electronic device of claim 5, wherein the burn-in compensation processing is configured to up-sample the one or more burn-in compensation gain maps using bilinear interpolation.

7. The electronic device of claim 5, wherein the burn-in compensation processing is configured to up-sample the one or more burn-in compensation gain maps using nearest-neighbor interpolation.

8. The electronic device of claim 1, wherein the one or more image processing blocks comprise burn-in statistics collection processing configured to compute incremental updates of pixel aging that is expected to occur due to the display image data or a current temperature of an area of the electronic display, or both, wherein the incremental updates are based at least in part on the display image data and the global brightness setting, wherein the electronic device comprises a processor configured to interact with the display pipeline, wherein the processor is configured to compute the one or more burn-in compensation gain maps based at least in part on an accumulation of the incremental updates of sub-pixel aging and provide the one or more burn-in compensation gain maps to the display pipeline.

9. The electronic device of claim 1, wherein the one or more global gain parameters comprises a normalization factor based on a maximum gain that is permitted to be applied to the sub-pixels of the image data.

10. The electronic device of claim 1, wherein the threshold amount comprises a 1 nit threshold amount.

11. The electronic device of claim 1, wherein the gains applied to all sub-pixels of a first color component are based at least in part on a first global gain parameter of the one or more global gain parameters and the gains applied to all sub-pixels of a second color component are based at least in part on a second global gain parameter of the one or more global gain parameters.

12. An electronic display pipeline configured to process image data for display on an electronic display, wherein the electronic display pipeline comprises:

burn-in compensation statistics collection processing circuitry configured to collect image statistics based at least in part on the image data, wherein the image statistics estimate a likely amount of non-uniform aging of sub-pixels of the electronic display; and burn-in compensation processing circuitry configured to apply a gain to the image data to account for non-uniform aging of corresponding sub-pixels of the electronic display, wherein the applied gain is based at least in part on the image statistics collected by the burn-in compensation statistics collection processing circuitry, and wherein the applied gain is applied to each of the sub-pixels for the image data based at least in part on one or more global gain parameters, wherein the one or more global gain parameters are based at least in part on a single global brightness setting of the electronic display that represents a present maximum luminance output setting for the electronic display, wherein the burn-in compensation processing circuitry is configured to determine a change in the single global brightness setting, wherein the one or more global gain parameters are recalculated in response to the change of the single global brightness setting being greater than a threshold amount.

13. The electronic display pipeline of claim 12, wherein the burn-in compensation processing circuitry is configured to apply the gain to the sub-pixels of the image data based on a map of gains stored in a framebuffer.

14. The electronic display pipeline of claim 12, wherein the burn-in compensation processing circuitry and the burn-in compensation statistics collection processing circuitry are configured to operate on the image data in a linear color space.

15. The electronic display pipeline of claim 14, comprising:

a deGamma block configured to receive input image data in a gamma color space, convert the input image data in the gamma color space into the image data in the linear color space, and provide the image data in the linear color space to the burn-in compensation processing circuitry; and a reGamma block configured to receive the image data in the linear color space from the burn-in compensation processing circuitry and convert the image data in the linear color space into output image data in the gamma color space for further processing in the electronic display pipeline or for display on the electronic display.

16. A method comprising:

processing a frame of image data in a display pipeline for display on an electronic display;

analyzing at least a portion of the frame of image data in the display pipeline before it is displayed on the electronic display to estimate a likely amount of aging by sub-pixels of the electronic display based at least in part on the portion of the frame of image data; and accumulating a history of the likely amount of aging by the sub-pixels of the electronic display to identify non-uniform sub-pixel aging on the electronic display;

performing burn-in compensation based at least in part on the accumulated history of the likely amount of aging by the sub-pixels of the electronic display and one or more global gain parameters to reduce or eliminate a burn-in artifact on the electronic display, wherein the one or more global gain parameters are based at least in part on a global brightness setting comprising a present maximum luminance output setting for the electronic display; and determining a change in the global brightness setting, wherein the one or more global gain parameters are recalculated in response to the change of the global brightness setting being greater than a threshold amount.

17. The method of claim 16, wherein analyzing at least the portion of the frame of image data to estimate the likely amount of aging by the sub-pixels of the electronic display comprises estimating the likely amount of aging due to luminance emitted by the sub-pixels of the electronic display when at least the portion of the frame of image data is displayed on the electronic display.

18. The method of claim 17, wherein estimating the likely amount of aging due to the luminance emitted by the sub-pixels of the electronic display comprises computing a function of a value of one of the sub-pixels of at least the portion of the frame of image data normalized to a brightness setting of the electronic display.

19. The method of claim 16, wherein analyzing at least the portion of the frame of image data to estimate the likely amount of aging by the sub-pixels of the electronic display comprises estimating the likely amount of aging due to a temperature of the electronic display when at least the portion of the frame of image data is displayed on the electronic display.

20. The method of claim 16, comprising:

identifying local temperatures at locations of the sub-pixels of the electronic display corresponding to at least the portion of the frame of image data; and estimating the likely amount of aging by the sub-pixels of the electronic display due at least in part to the local temperatures.

21. The method of claim 20, wherein identifying the local temperatures comprises obtaining temperature values from a two-dimensional temperature lookup table having unevenly spaced grid points.

* * * * *